US008725022B2

(12) United States Patent
Kamata

(10) Patent No.: US 8,725,022 B2
(45) Date of Patent: May 13, 2014

(54) IMAGE FORMING APPARATUS FOR PRINT JOB SCHEDULING

(75) Inventor: Yoshihisa Kamata, Hadano (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 578 days.

(21) Appl. No.: 12/783,336

(22) Filed: May 19, 2010

(65) Prior Publication Data

US 2010/0296830 A1 Nov. 25, 2010

(30) Foreign Application Priority Data

May 22, 2009 (JP) ..... 2009-123844

(51) Int. Cl.
*G03G 15/00* (2006.01)

(52) U.S. Cl.
USPC ..... 399/81; 399/82

(58) Field of Classification Search
USPC ..... 399/81, 82
See application file for complete search history.

(56) References Cited

U.S. PATENT DOCUMENTS

| | | | | |
|---|---|---|---|---|
| 7,355,733 | B2 * | 4/2008 | Sommer et al. | 358/1.15 |
| 2004/0218197 | A1 * | 11/2004 | Vliembergen et al. | 358/1.6 |
| 2005/0270563 | A1 * | 12/2005 | Kamata et al. | 358/1.15 |
| 2006/0245780 | A1 * | 11/2006 | Yamada | 399/81 |
| 2010/0034550 | A1 * | 2/2010 | Arai et al. | 399/81 |
| 2010/0046977 | A1 * | 2/2010 | Inenaga et al. | 399/81 |

FOREIGN PATENT DOCUMENTS

| | | |
|---|---|---|
| JP | 10-333848 | 12/1998 |
| JP | 2001-353913 | 12/2001 |
| JP | 2003-233275 | 8/2003 |
| JP | 2004-348713 | 12/2004 |
| JP | 2005-345732 | 12/2005 |

OTHER PUBLICATIONS

Notification of Reasons for Refusal with English language translation mailed by the Japanese Patent Office on Dec. 18, 2012, in counterpart Japanese application No. 2009-123844.

* cited by examiner

*Primary Examiner* — Ryan Walsh
(74) *Attorney, Agent, or Firm* — Buchanan Ingersoll & Rooney PC

(57) ABSTRACT

Disclosed is an image forming apparatus including a storage unit which stores job data of a reserved job, an image forming unit which executes an image forming based on the job data of the reserved job, a paper feeding unit which stores a paper to be supplied to the image forming unit, a display unit, a control unit which determines whether a type of a paper to be used in the reserved job is different from a type of a paper which is stored in the paper feeding unit or not, and allows the display unit to display a job scheduling screen for displaying reservation information indicating a time required for an execution of the reserved job by including a predetermined notification when the control unit determines that the type of the paper to be used in the reserved job is different from the type of the paper which is stored in the paper feeding unit.

12 Claims, 13 Drawing Sheets

FIG.10A

FIG.10B

FIG.10C

IMAGE FORMING APPARATUS FOR PRINT JOB SCHEDULING

BACKGROUND OF THE INVENTION

1. Field of the Invention

The present invention relates to an image forming apparatus.

2. Description of Related Art

In POD (Print On Demand), great amount of paper is used every time a job is executed. In the image forming apparatus for POD or in trays connected to the image forming apparatus, papers are stored according to each type. Because image forming stops when a paper-out condition occurs, information to distinguish the tray in which the paper-out condition occurred is displayed in a monitor. Also, when paper of a type which is needed for the job which a user intended to execute is not stored in a tray, a notification indicating that there is no paper of the type which is needed for the job intended to be executed by a user is shown in the monitor and a user carries out replacing or the like of paper in the tray.

JP 2004-348713 describes a printing system which displays size and paper type information of the paper in a tray in a monitor, and notifies how much time is needed till job completion and the timing when the paper-out condition occurs during execution of a job when the job is executed by using this particular paper to encourage a user to supply the paper.

JP 2005-345732 describes an image forming apparatus in which various types of papers having different paper types and basis weights which are needed for each of the jobs can be reserved and which can effectively carry out a paper replacement operation when executing a job in which paper which is not stored in the trays is needed.

SUMMARY OF THE INVENTION

For a user to carry out paper replacement, there is a need for a user to recognize detail information such as the timing to replace paper the tray, size and paper type of the paper which is needed for the reserved job. However, the techniques described in JP 2004-348713 and JP 2005-345732 do not allow a user to recognize the execution order, the time relation and the like between the job which uses the paper stored in the tray and the reserved job. Therefore, a user cannot carry out an effective paper replacing operation.

According to a first aspect of the present invention, there is provided an image forming apparatus comprising a storage unit which stores job data of a reserved job, an image forming unit which executes an image forming based on the job data of the reserved job, a paper feeding unit which stores a paper to be supplied to the image forming unit, a display unit, a control unit which determines whether a type of a paper to be used in the reserved job is different from a type of a paper which is stored in the paper feeding unit or not, and allows the display unit display a job scheduling screen for displaying reservation information indicating a time required for an execution of the reserved job by including a predetermined notification when the control unit determines that the type of the paper to be used in the reserved job is different from the type of the paper which is stored in the paper feeding unit.

BRIEF DESCRIPTION OF THE DRAWINGS

The present invention will become more fully understood from the detailed description given hereinbelow and the appended drawings, and thus are not intended as a definition of the limits of the present invention, and wherein:

FIGS. 10A to 10C are schematic diagrams showing a print queue;

DESCRIPTION OF THE PREFERRED EMBODIMENTS

Figure 1:
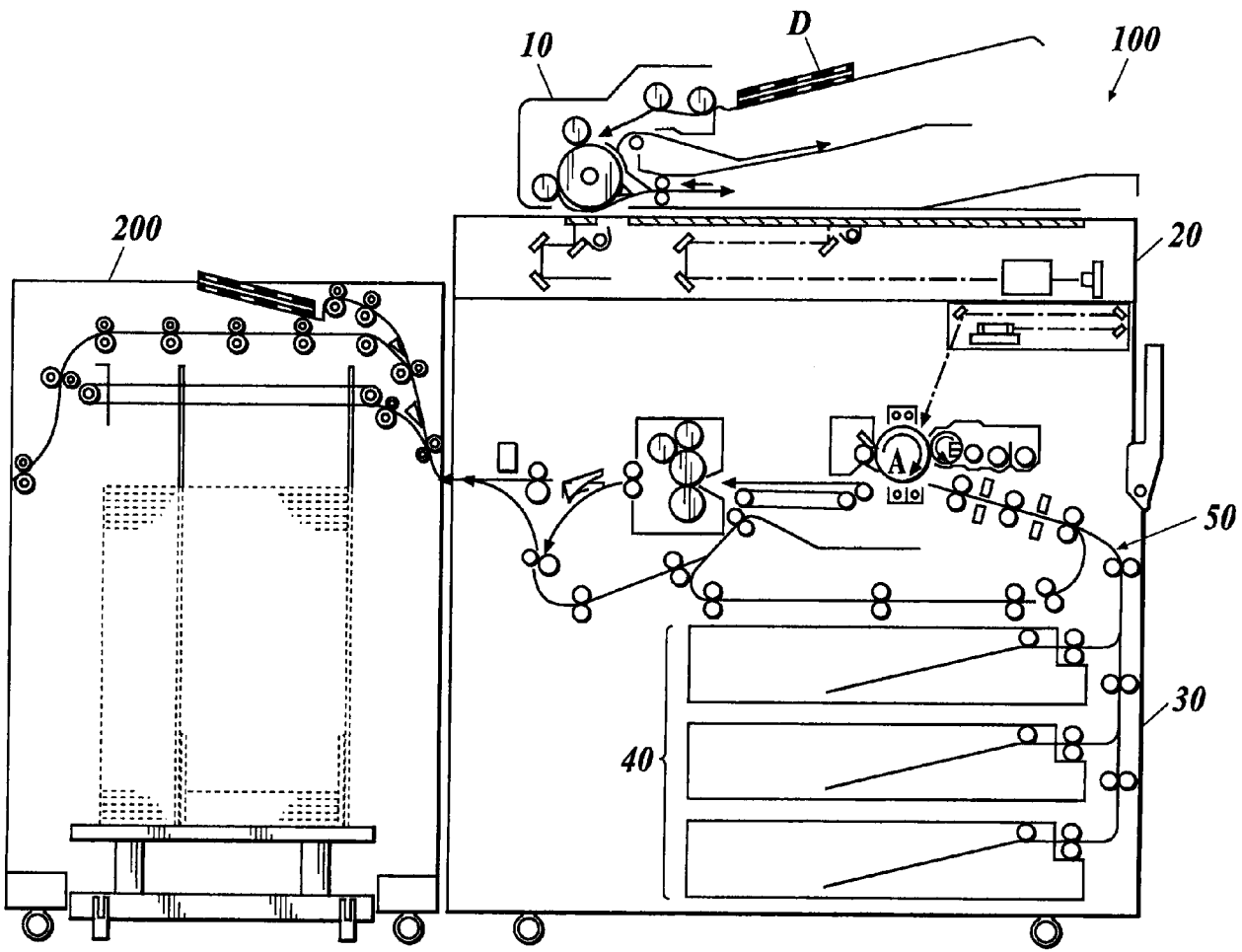
FIG. 1 is a schematic cross sectional diagram of an image forming apparatus of an embodiment.

First, an image forming apparatus 100 according to the embodiment will be described with reference to FIG. 1.

The image forming apparatus 100 comprises an automatic document transfer device 10, a reading device 20, a printer device 30, an after-processing device 200 and the like.

The automatic document transfer device 10 is a device to transfer document D which is mounted on a mounting tray one by one to the reading position of the trading device 20. Further, when images are formed on both sides of the document D, the automatic document transfer device 10 reverses front and back of the document D and transfers the document D again to the reading position after reading one side of the document D.

The automatic document transfer device 10 is provided with a paper feeding roller or the like to transfer the document D which is mounted on the mounting tray in order from the top, and is provided with a paper ejection tray or the like to which the document D is ejected after the automatic document transfer device 10 transfers the document D to the reading position of the reading device 20. Further, the automatic document transfer device 10 can reverse front and back of the document D by a reverse roller so that both sides of the document D can be read.

The reading device 20 reads an image from the document D which is transferred by the automatic document transfer device 10 to generated image data which expresses the read image.

The reading device 20 comprises a light exposure scanning unit which is provided with a light source and a mirror, a line image sensor to receive reflection light from the document D and to carry out an opto-electric conversion to convert the light-amount signal thereof to an electric signal, a condenser lens to focus the reflection light from the document D to the line image sensor and the like.

The printer device 30 is a device to form an image on a paper which is stored in the paper feeding unit 40 by an electrophotographic process based on job data.

The printer device 30 comprises a laser unit to output a laser beam which switches ON/OFF according to the image data included in an inputted job data, a photoreceptor drum on which an electrostatic latent image is formed on the surface thereof, a charging device which is disposed at circumference of the photoreceptor drum and the like.

The paper feeding unit 40 of the printer device 30 comprises a plurality of paper feeding trays and high-capacity post inserters and the like, and the paper feeding unit 40 of the printer device 30 supplies paper to the printer device 30 via the transfer unit 50 according to an instruction of the control unit 101.

Moreover, the after-processing device 200 is connected to the image forming apparatus 100. The after-processing device 200 executes various types of after-processing to the paper which is ejected from the image forming apparatus 100.

Figure 2:
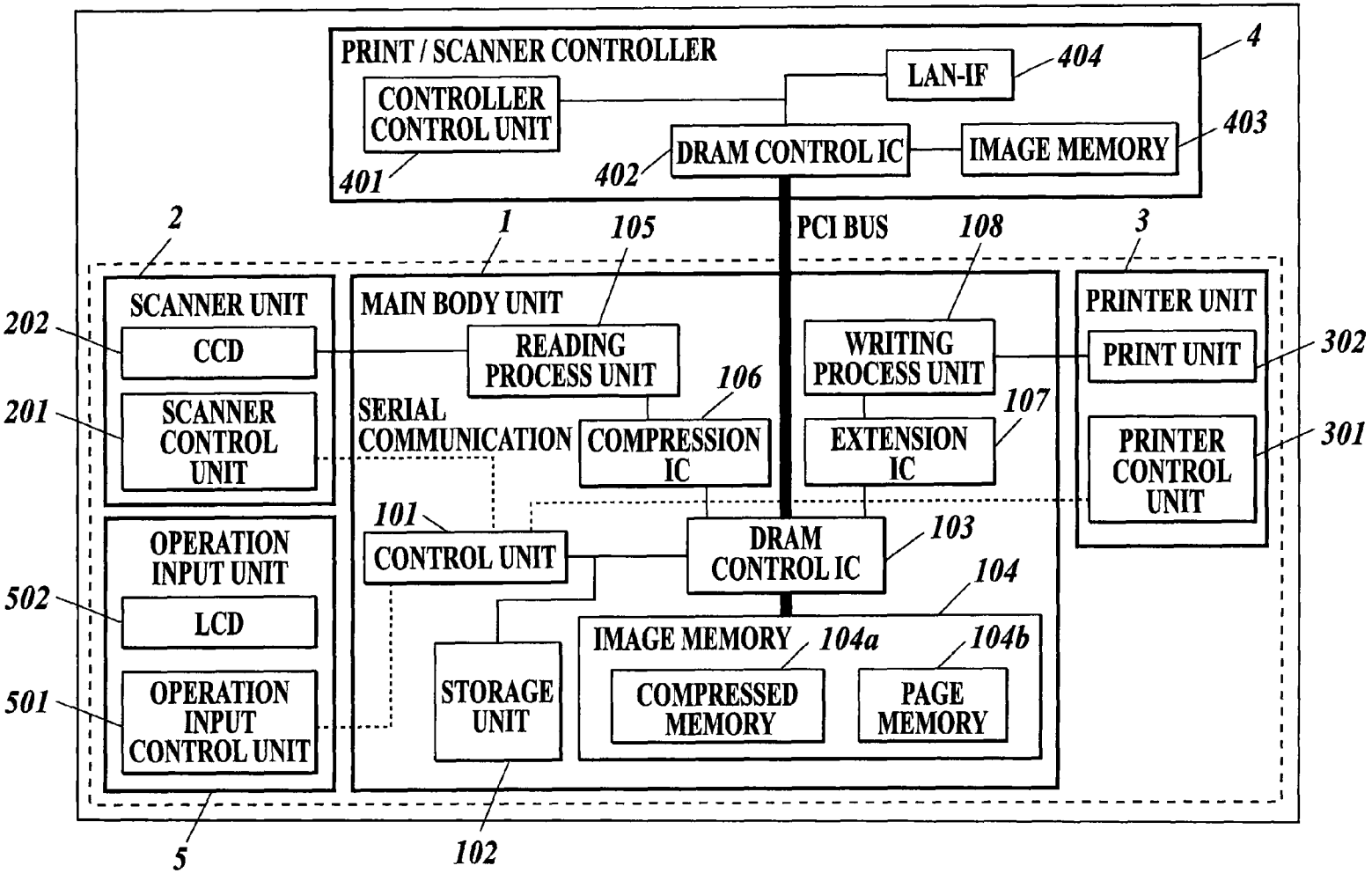
FIG. 2 is a control block diagram of the image forming apparatus shown in FIG. 1.

In FIG. 2, a functional block diagram of the image forming apparatus 100 is shown.

The image forming apparatus 100 comprises a main body unit 1, a scanner unit 2, a printer unit 3, a print/scanner controller 4 and an operation input unit 5.

The main body unit 1 comprises a control unit 101, a storage unit 102, a DRAM control IC 103, an image memory 104, a reading process unit 105, a compression IC 106, an extension IC 107, a writing process unit 108 and the like.

The control unit 101 comprises a CPU (Central Processing Unit) and the like, and the control unit 101 reads out the system program stored in the storage unit 102 to expand the system program in a RAM (omitted from the drawing) and integrally controls operation of each unit of the image forming apparatus 100 according to the expanded program. Further, the control unit 101 switches between the copy mode, the printer mode and the scanner mode based on an operation signal of the operation input unit 5 and job data inputted via the print/scanner controller 4, and the control unit 101 reads a process program corresponding to each mode which is stored in the storage unit 102 to execute the image forming process.

The storage unit 102 comprises a HDD (Hard Disk Drive), a non-volatile semiconductor memory and the like, and the storage unit 102 is provided with the system program corresponding to the image forming apparatus 100 and various types of process programs which can be executed on the system program. Further, the storage unit 102 stores setting information needed to execute various types of process programs and stores data and the like after execution. Furthermore, the storage unit 102 stores reserved jobs in the after-mentioned print queue. In the embodiment, the job data to be stored in the storage unit 102 includes a job ID to distinguish each job, one-side/both-side information to distinguish one-side printing and both-side printing, information of tray to be used to distinguish a tray to be used and the like, information to distinguish paper to be used in a job, number of copies output, number of sheets of paper output and the like. The information to distinguish the paper to be used in a job is information indicating the paper type, the basis weight, the color and the with/without hole punching and the like.

Moreover, the storage unit 102 stores information of the papers which are stored in the paper feeding unit 40. For example, the storage unit 102 stores information indicating size, paper type, basis weight, color, with/without hole punching and the like of the paper stored in each paper feeding tray of the paper feeding unit 40. These information can be inputted by an operation of a user who stored the paper in the paper feeding unit 40 or can be stored in the storage unit 102 by the information being inputted from an external device and the like connected by a network.

The DRAM control IC 103 controls the reading of data to the image memory 104 and reading out of data from the image memory 104. Further, the DRAM control IC 103 is connected to the DRAM control IC 402 in the print/scanner controller 4 by a PCI bus, and the DRAM control IC 103 controls input and output of data between the print/scanner controller 4 and the main body unit 1.

The image memory 104 comprises a DRAM (Dynamic Random Access Memory) and includes a compressed memory 104*a* and a page memory 104*b*. The compressed memory 104*a* temporarily stores data such as image data which is compressed in the compression IC 106 by the control of the DRAM control IC 103. The page memory 104*b* temporarily stores the image data outputted from the print/scanner controller 4 and temporarily stores the image data which is expanded to be outputted to the print/scanner controller 4 by the control of the DRAM control IC 103.

The reading process unit 105 converts an analog electric signal which is read by the scanner unit 2 into a digital data which can be processed in the main body unit 1 and outputs the converted digital data to the compression IC 106.

The compression IC 106 compresses the image data which is outputted from the print/scanner controller 4 and the image data outputted from the reading process unit 105.

The extension IC 107 expands the compressed data which is outputted from the DRAM control IC 103.

The writing process unit 108 inputs the image data to which image process such as expansion, reduction, rotation, relocation and the like is carried out according to the instruction data outputted from the operation input unit 5 and the print/scanner controller 4 from the extension IC 107 and outputs the image data to the printer unit 3 after carrying out a revision process as needed.

The scanner unit 2 comprises a scanner control unit 201, a CCD 202 and the like.

The scanner control unit 201 receives a control signal from the control unit 101 and controls the drive of the CCD 202.

The CCD (Charge Coupled Device) 202 reads a document image by carrying out imaging of the reflection light of the light from the light source (omitted from the drawing) which carried out an illumination scanning to the document to carry out opto-electric conversion and outputs the read image data to the reading process unit 105. Here, image data is not limited to image data such as graphics and photographs and the like, and image data includes text data such as letter, symbols and the like.

The printer unit 3 comprises a printer control unit 301 and a print unit 302.

The printer control unit 301 receives the control signal from the control unit 101 and forms an electrostatic latent image on the surface of the photoreceptor drum by controlling the drive of the LD (Laser Diode) based on the image data from the writing process unit 108. The print unit 302 is an image forming unit which comprises an LD, a photoreceptor drum, a paper ejection unit and the like. The print unit 302 develops the electrostatic latent image on the surface of the photoreceptor drum by toner and transfers and fixes the toner image on a paper which is transferred from the paper feeding unit 40, and there after, ejects the paper.

The print/scanner controller 4 comprises a controller control unit 401, a DRAM control IC 402, an image memory 403, a LAN-IF 404 and the like.

The controller control unit 401 controls the operation of each unit of the print/scanner controller 4 and carries out sending and receiving of data between a personal computer (omitted from the drawing) connected by a network.

The image memory 403 temporarily stores the image data which is received from the personal computer via the network, the image data which is outputted from the main body unit 1 through the PCI bus and the like by the control of the DRAM control IC 402.

The LAN-IF 404 is an interface for the image forming apparatus 100 to connect with the personal computer via the network.

The operation input unit 5 comprises an operation input control unit 501, a LCD (Liquid Crystal Display) 502 as a display unit having a touch panel and the like.

The operation input control unit 501 receives a display signal from the control unit 101 and carries out a display control of the LCD 502. Further, the operation input control unit 501 outputs an operation signal which is inputted from the touch panel on the LCD 502 to the control unit 101.

The LDC 502 displays various types of operation buttons, a condition display of an image, an operation status of each function and the like on the screen according to the instruction of the display signal which is inputted from the operation input control unit 501. The display screen of the LCD 502 is covered with a transparent sheet panel, and the display screen is structured by a touch panel which outputs the position information which is inputted by touching the screen with a finger or a special styluspen to the operation input control unit 501 as input information.

Next, a job scheduling screen G displayed in the LCD 502 will be described with reference to FIG. 3. Here, in the description hereinbelow, the job scheduling screen G in which the second axis shows the time needed for execution of each job (hereinafter, time required) will be described.

The job scheduling screen G is a screen in which various types of information such as information relating to a tray to be used in each reserved job, information relating to the paper-out condition of each reserved job, reservation information and the like are displayed on a two-dimensional table having two axes which are orthogonal to each other. The job scheduling screen G includes a vertical axis display unit 51, a horizontal axis display unit 52 and a reservation information display unit 53.

The vertical axis display unit 51 is provided along the first axis which is the vertical axis and displays paper feeding unit information. The paper feeding unit information is information to distinguish each tray which constitutes the paper feeding unit 40 to be used in the image forming apparatus 100 and information relating to paper stored in each of the trays. In an example described hereinbelow, the paper feeding unit 40 comprises paper feeding trays FT1 to FT8, high-capacity post inserters PFU1 to PFU3, post inserters PI1 and PI2 and a tray PB for bundle bookbinding.

Figure 3:
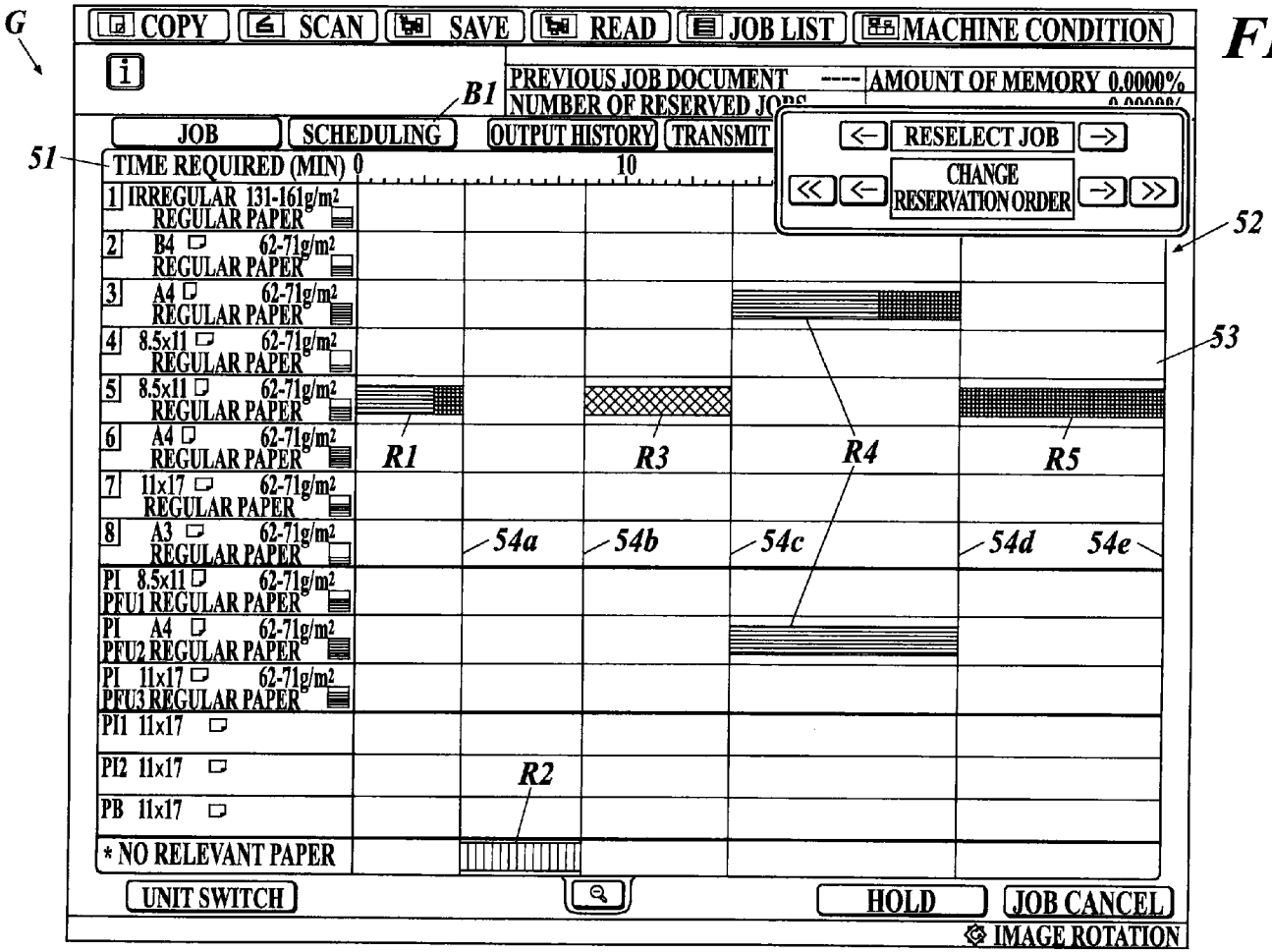
FIG. 3 is an example of a job scheduling screen which is to be displayed in the LCD shown in FIG. 2.

The vertical axis display unit 51 shown in FIG. 3 is divided in 14 lines each of which corresponding to each of the paper feeding trays FT1 to FT8, the high-capacity post inserters PFU1 to PFU3, the post inserters PI1 and PI2 and the tray PB for bundle bookbinding and one line which indicates that the tray specified in the job data does not exist. In each of the lines corresponding to the paper feeding unit 40, information relating to the paper stored in each of the trays is displayed. This information is displayed based on the information stored in the storage unit 102.

For example, the first line which is at the top of the vertical axis display unit 51 is a line corresponding to "paper feeding tray FT1", and the paper type of "regular paper", paper size of "irregular" and basis weight of "131-161 g/m$^2$" relating to the paper which is stored in the paper feeding tray FT1 are displayed.

Further, as shown in FIG. 3, in the first line to the eighth line in the vertical axis display unit 51 each of which corresponding to each of the paper feeding trays FT1 to FT8, the ninth line to the eleventh line in the vertical axis display unit 51 each of which corresponding to each of the high-capacity post inserters PFU1 to PFU 3, the twelfth line and the thirteenth line in the vertical axis display unit 51 each of which corresponding to each of the post inserters PI1 and PI2 and the fourteenth line corresponding to the tray PB, the time required for each job is schematically displayed. In the example shown in FIG. 3, color of the lines showing the time required correspond to estimated paper remaining amount in the paper feeding unit of each line or the reservation condition of the paper feeding unit 40.

The horizontal axis display unit 52 is provided along the second axis which is the horizontal axis and includes a scale showing the time required for jobs. The origin of the second axis indicates zero which is the current time, and in the job scheduling screen G of FIG. 3, one scale of the second axis corresponds to 30 seconds.

Moreover, at the lower portion of the job scheduling screen G, an expansion/reduction button to change the display scale of the second axis of the scheduling screen is provided. When the expansion/reduction button is operated on the job scheduling screen G of FIG. 3, the job scheduling screen G in which the display scale of the second axis of the job scheduling screen G is enlarged is to be displayed. For example, the display scale of the second axis is enlarged in such way that one scale of the second axis be equivalent to one minute when the expansion/reduction button is pushed.

In the reservation information display unit 53, reservation information R of each reserved job is displayed. The reservation information R is information which indicates the tray to be used and the time required for the job execution by being displayed at the position on the first axis corresponding to the tray to be used in the job and by being display in a region constituted of the position on the second axis for a length corresponding to the time required for the job execution. As for the calculation method of the time required, various methods which are well known can be used, and the time required is calculated from various types of print conditions such as number of copies output, number of sheets of paper output and the like included in the job data.

In the job scheduling screen G of FIG. 3, five reservation information R1 to R5 each of which corresponding to each of the five reserved jobs 1 to 5 are shown.

Here, in the job scheduling screen G of FIG. 3, the job which is being executed is also displayed by the reservation information R1 (job bar) displayed in a band-like display as the job which is the first in the execution reservation order. As for the job which is being executed, the remaining of the time required of the job at the display timing is displayed as the time required.

In a display process of the above described job scheduling screen G, the control unit 101 specifies the paper feeding unit 40 to be used in each job and specifies the position on the fist axis (first line to fourteenth line) corresponding to the paper feeding unit 40 based on job data of each job which is reserved in a print queue. Then, the control unit 101 displays the reservation information R of each reserved job at the position on the first axis corresponding to the paper feeding unit 40 to be used in the job and calculates the time required based on the job data. The calculated length of each reservation information R in the second axis direction is set so as to be the length corresponding to the time required of the job. Further, although the detail will be described later, each reservation information R is displayed in a color corresponding to the remaining amount of paper in each tray of the paper feeding unit 40 and the reservation condition of the paper feeding unit 40.

As described above, in the job scheduling screen G, by the reservation information R of each job being displayed at the position on the first axis corresponding to the tray to be used and at the position on the second axis in a length corresponding to the number of sheets of paper planned to be used, the time required for execution of each job and the remaining amount of paper and the reservation condition of each tray and the like of the paper feeding unit 40 can be recognized by the color of the reservation information.

That is, when displaying the reservation information R1 of the job 1 which is the first in the execution reservation order in the job scheduling screen G of FIG. 3, the control unit 101 displays the reservation information R1 in the fifth line corresponding to the paper feeding tray FT5 which is to be used in job 1, and by setting the length of the reservation information R1 in the second axis direction so as to correspond to the time required which is calculated based on the job data of job 1 (in case of the example in FIG. 3, 8 scales equivalent to four minutes), it can be recognized that job 1 will use the paper in the paper feeding tray FT1 for four minutes. Further, the reservation information is color coded based on the number of print copies and the number of sheets of paper per copy included in the job data and the paper remaining amount data stored in the paper feeding tray FT1.

Moreover, based on the job data of each job stored in the storage unit 102, the control unit 101 calculates the time required for each job in order of the execution reservation order. Further, by displaying the reservation information R of each job in the job scheduling screen G so as to be at the position in which the position in the second axis direction where the estimated finish time of a job which comes before in the execution reservation order than the job is estimated is set as the start point, the cumulative total of the time required in the entire job at an arbitrary time during the execution of each job can be recognized.

In particular, as shown in the job scheduling screen G of FIG. 3, the control unit 101 displays the reservation information R1 of job 1 at the position on the second axis in which the origin of the second axis is set as the start point and the position proceeding for 8 scales in the second axis direction from the start point, corresponding to "4 minutes" which is the time required for the paper in the job, is set as the end point.

Next, the control unit 101 displays the reservation information R2 of job 2 at the position on the second axis in which the position on the second axis indicating "4 minutes" which is the time required for job 1 (that is, the position proceeding 8 scales from the origin) is set as the start point and the position proceeding 9 scales in the second axis direction from the start point, corresponding to "4 minutes and 30 seconds" which is the time required for the job 2 (that is, the position proceeding 17 scales from the origin), is set as the end point. Here, it is determined that there is no relevant paper for job 2.

Then, the control unit 101 displays the reservation information R3 of job 3 at the position on the second axis in which the position on the second axis indicating "8 minutes and 30 seconds" (that is, the position proceeding 17 scales from the origin) which is the estimated value of the time required for jobs 1 and 2 which come before in the execution reservation order is set as the start point and the position proceeding 11 scales in the second axis direction from the start point (that is, the position proceeding 28 scales from the origin), corresponding to "5 minutes and 30 seconds" which is the time required for job 3, is set as the end point.

Thereafter, the control unit 101 displays the reservation information R4 of the job 4 at the position on the second axis in which the position on the second axis indicating "14 minutes" (that is, the position proceeding 28 scales from the origin) which is the estimated value of the time required for jobs 1 to 3 which come before in the execution reservation order is set as the start point and the position proceeding 16 scales in the second axis direction from the start point (that is, the position proceeding 44 scales from the origin), corresponding to "8 minutes" which is the time required for the job 4, is set as the end point.

Next, the control unit 101 displays the reservation information R5 of job 5 at the position on the second axis in which the position on the second axis indicating "22 minutes" (that is, the position proceeding 44 scales from the origin) which is the estimated value of the time required for jobs 1 to 4 which come before in the execution reservation order is set as the start point and the position proceeding 16 scales in the second axis direction from the start point (that is, the position proceeding 60 scales from the origin), corresponding to "8 minutes" which is the time required for job 5, is set as the end point.

Further, when the estimation of the time required for the job is more than the time corresponding to the remaining portion in the second axis, the control unit 101 displays the reservation information R by setting the right end of the two-dimensional table as the end point.

Furthermore, in the job scheduling screen G, the control unit 101 displays separator lines showing breaks of each of the jobs at the borders of the reservation information R of each of the jobs in the second axis direction so as to be parallel to the first axis so that the reservation information R of each job can be distinguished individually.

That is, as shown in FIG. 3, the control unit 101 displays the separator line 54*a* at the border of the reservation information R1 of job 1 and the reservation information R2 of job 2. Further, the control unit 101 displays the separator line 54*b* at the border of the reservation information R2 of job 2 and the reservation information R3 of job 3. Furthermore, the control unit 101 displays the separator line 54*c* at the border of the reservation information R3 of job 3 and the reservation information R4 of job 4. Moreover, the control unit 101 displays the separator line 54*d* at the border of the reservation information R4 of job 4 and the reservation information R5 of job 5. Further, the control unit 101 displays the separator line 54*e* at the end point of the reservation information R5 of job 5. In such way, information of each job is clearly and easily distinguished from the information of the jobs which come before and behind in the execution reservation order and the information of each job can be recognized individually.

Moreover, the control unit 101 updates the display position of each reservation information R in the job scheduling screen G by setting the origin of the second axis as the current time point at a predetermined update timing. The predetermined update timing is when the image forming process to a predetermined number of sheets of paper is finished or when a predetermined time has passed since the previous update timing, and a user can set which timing is to be applied for the update timing of the job scheduling screen G in advance in the setting screen which is omitted from the drawing.

When the update timing is set to every time when the image forming process to a predetermined number of sheets of paper is finished, every how many numbers of sheets of paper the update should be carried out can be further set. A user can set so as to carry out the update of the job scheduling screen G for every sheet of paper, every 10 sheets of paper or every 100 sheets of paper, for example.

On the other hand, when the update timing is set to when a predetermined time elapsed since the previous update timing, every how many seconds/minutes/hours the update should be carried out can be further set. A user can set so as to carry out the update of the job scheduling screen G for every 10 seconds, every 60 seconds or every 10 minutes, for example.

Moreover, the control unit 101 determines whether the paper shortage condition occurs during execution of the job or not for each of the reserved jobs, and the control unit 101 specifies the deficiency of paper and the timing when the paper shortage condition occurs when it is determined that the paper shortage condition occurs during execution of the job. Further, in the reservation information display unit 53 in the job scheduling screen G, the reservation information R of each job is displayed according to a mode corresponding to the paper shortage condition or to a case where the paper stored in the paper feeding unit 40 and the paper specified in the reserved job do not match, for example, the reservation information R is displayed in blue when there is sufficient remaining amount of paper and printing can be carried out continuously, the reservation information R is displayed in yellow for the portion after the paper shortage condition occurs when there is a possibility that the paper shortage condition occurs during the job output, the reservation information R is displayed in red for the portion after the printing stops when the printing stops because the paper shortage condition occurs during the printing, the reserved job is displayed in orange when it is determined that the paper to be used in the reserved job and the paper stored in the tray do not match by the after-mentioned process and the like.

In particular, the control unit 101 calculates the estimated remaining amount of paper in each of the paper feeding trays FT1 to FT8 based on the detection value from the remaining amount detection sensor which is provided at the paper feeding unit 40. Based on the number of sheets of paper planed to be used which is calculated from the job data of the previous job which comes before in the execution reservation order which uses the same tray, the estimated remaining amount of paper in the tray is compared to the number of sheets of paper to be used in the job to determine whether the paper shortage condition occurs during execution of the job or not, and the reservation information is made to be in yellow at the timing when the estimated remaining amount of paper falls below the predetermined number of sheets of paper and the reservation information is made to be in red at the timing when the estimated remaining amount of paper be zero. Here, in the embodiment, the accidental error (specified in the storage unit 102 or the like in advance) of the estimated remaining amount of paper in each of the paper feeding trays FT1 to FT8 which are calculated based on the detection value from the remaining amount detection sensor provided at the paper feeding unit 40 are being considered. For example, when this accidental error is set to be plus or minus 10% of the calculated estimated remaining amount, the minimum value of the estimated remaining amount is 90% of the estimated remaining amount which is calculated based on the detection value from the remaining amount detection sensor and the maximum value of the estimated remaining amount is 110% of the estimated remaining amount which is calculated based on the detection value from the remaining amount detection sensor.

That is, the minimum value of the estimated remaining amount of the paper in the paper feeding tray FT5 is "388 sheets" and the maximum value is "550 sheets", and when there is no previous job which uses the same paper feeding tray FT5, the estimated remaining amount of paper in the paper feeding tray FT5 has the minimum value of "388 sheets" and the maximum value of "550 sheets" at the time when execution of job 1 starts. Further, the control unit 101 compares "388 sheets" which is the minimum value of the estimated remaining amount of paper in the paper feeding tray FT5 at the time when execution of job 1 starts to "200 sheets" which is the number of sheets of paper planned to be used in job 1. When the control unit 101 determines that "388 sheets" which is the minimum value of the estimated remaining amount of paper in the paper feeding tray FT5 at the time when execution of job 1 starts is greater than "200 sheets" which is the number of sheets of paper planned to be used in job 1, the control unit 101 determines that the paper shortage condition does not occur and displays the entire reservation information R1 in blue. In a case where the estimated remaining amount of paper stored in the paper feeding tray FT5 falls below the predetermined number of sheets of paper during the execution of the job, the portion of the reservation information R1 after the point where the estimated remaining amount of paper falls below the predetermined number of sheets of paper may be displayed in yellow (see reservation information R1 and R4 of FIG. 3). Here, the number of sheets of paper planned to be used in job 1 is determined based on the job data, and for example, a numeral value in which the number of copies output included in the job data is multiplied by the number of sheets of paper to be used per copy included in the job data is applied. Here, notification of the paper shortage condition is not limited to the above example as long as the paper shortage condition can be recognized by a predetermined display in the job scheduling screen G. For example, ways of applying hatching to the reservation information R or the like can be used to recognize instead of color coded display of the reservation information R.

In such way, in the job scheduling screen G, by the entire reservation information R1 of job 1 being displayed in blue, a user can easily recognize that all of the image forming process of job 1 can be executed without stopping because of paper shortage condition.

Moreover, in a case where the estimated remaining amount of paper in the paper feeding tray FT5 has the minimum value of "1092 sheets" and the maximum value of "1216 sheets" and there is no previous job that uses the same paper feeding tray FT5 before, the estimated remaining amount of paper in the paper feeding tray FT5 has the minimum value of "1292 sheets" and the maximum value of "1216 sheets" at the time when execution of job 1 starts. Further, the control unit 101 compares "1092 sheets" which is the minimum value of the estimated remaining amount of paper in the paper feeding tray FT5 at the time when execution of job 1 starts to "1400 sheets" which is the number of sheets of paper planned to be used in job 2 to determine whether "1092 sheets" which is the minimum value of the estimated remaining amount of paper in the paper feeding tray FT5 at the time when execution of job 1 starts is smaller than "1400 sheets" which is the number of sheets of paper planned to be used in the job or not. When the control unit 101 determines that the minimum value of the estimated remaining amount of paper in the paper feeding tray FT5 at the time when execution of job 1 starts is smaller than the number of sheets of paper planned to be used in the job, the control unit 101 further compares "1216 sheets" which is the maximum value of the estimated remaining amount of paper in the paper feeding tray FT5 at the time when execution of job 1 starts to "1400 sheets" which is the number of sheets of paper planned to be used in job 1 to determine whether "1216 sheets" which is the maximum value of the estimated remaining amount of paper in the paper feeding tray FT5 at the time when execution of job 1 starts is smaller than "1400 sheets" which is the number of sheets of paper planned to be used in the job or not. Further, as shown in FIG. 3, when the control unit 101 determines that the maximum value of the estimated remaining amount of paper in the paper feeding tray FT5 at the time when execution of job 1 starts is smaller than the number of sheets of paper planned to be used in the job, the control unit 101 determines that the paper shortage condition will occur.

Here, in the reservation information R, the region displayed in blue indicates that there are sufficient paper remaining in the tray to be used and that the possibility of the image forming process stopping due to occurrence of the paper shortage condition is low at the timing in the region displayed in blue.

Further, in the reservation information R, the region displayed in yellow indicates that there is a possibility that the paper in the tray to be used run out and that there is a possibility that the image forming process stops due to occurrence of the paper shortage condition at the timing in the region displayed in yellow.

Furthermore, in the reservation information R, the region displayed in red indicates that paper in the tray to be used will run out and that there is a great possibility that the image forming process will stop due to occurrence of the paper shortage condition at the timing in the region displayed in red. Moreover, even in the case where there is no relevant paper, the reservation information is to be displayed in red.

In such way, in the job scheduling screen G, the reservation information R1 of job 1 is displayed by being color coded in plurality of colors according to the remaining amount of paper in the tray in each of the timings. Thereby, a user can recognize at which timing there is a possibility that the image forming process of job 1 stops due to occurrence of the paper shortage condition.

That is, the control unit 101 estimates the time required for the reserved jobs 1 to 5 and the number of sheets of paper planned to be used in each job for each of the trays.

For example, in a case where job 1 uses 200 sheets of paper in the paper feeding tray FT1, job 2 uses 1400 sheets of paper in the paper feeding tray FT4, job 3 uses 480 sheets of paper in the paper feeding tray FT1, job 4 uses 120 sheets of paper in the paper feeding tray FT2 and job 5 uses 100 sheets of paper in the paper feeding tray FT1, the estimated value of the number of sheets of paper planned to be used in the paper feeding tray FT1 is calculated to be "780 sheets", the estimated value of the number of sheets of paper planned to be used in the paper feeding tray FT2 is calculated to be "120 sheets" and the estimated value of the number of sheets of paper planned to be used in the paper feeding tray FT4 is calculated to be "1400 sheets".

Next, operation of the image forming apparatus 100 will be described.

Figure 12:
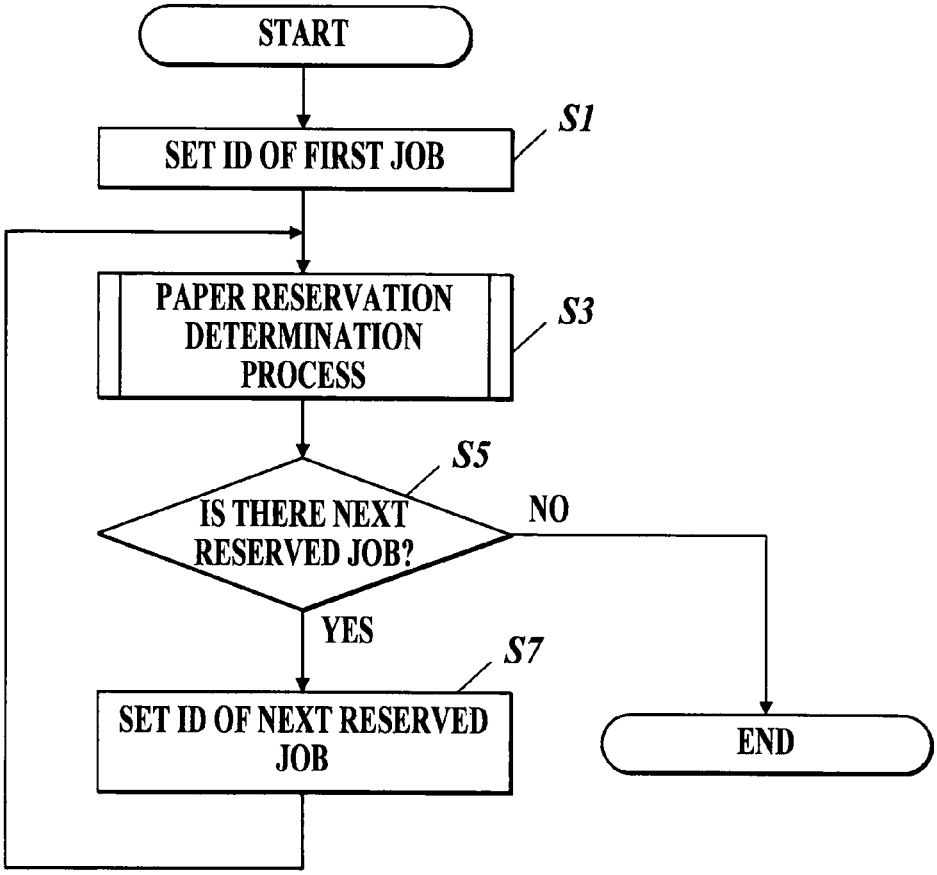
FIG. 12 is a flowchart of a process which is executed by a control unit shown in FIG. 2.

In FIG. 12, a flowchart of a process to be executed when execution of a job is instructed to the control unit 101 is shown. The process is executed by the control unit 101 cooperating with the programs stored in the storage unit 102.

First, ID of the first job which is stored in a print queue is set in the RAM of the control unit 101 (step S1). Next, a paper reservation determination process (after-mentioned) will be executed (step S3).

The control unit 101 determines whether there is next reserved job in the print queue or not (step S5). When the control unit 101 determines that there is next reserved job (step S5; YES), ID of this next reserved job is set in the RAM of the control unit 101 (step S7). Next, the process returns to step S3 to execute the paper reservation determination process based on the ID of the next reserved job.

When the control unit 101 does not determine that there is next reserved job (step S5; NO), the process ends.

Figure 13:
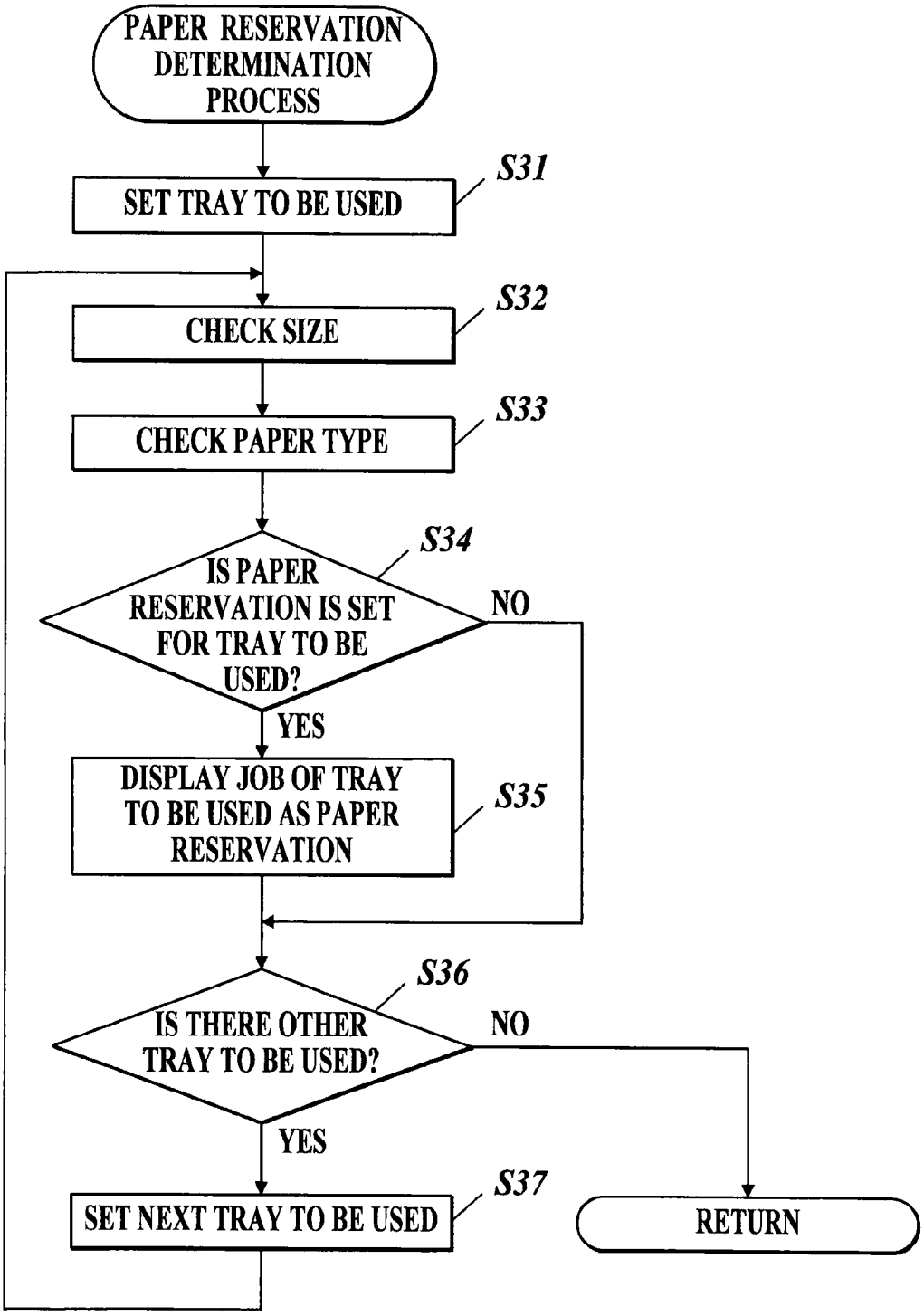
FIG. 13 is a flowchart of a paper reservation determination process which is executed by the control unit shown in FIG. 2.

In FIG. 13, a flowchart of the paper reservation determination process which is executed in step S3 is shown. As shown in FIG. 13, first, job data is referred based on the ID of the reserved job which is set in the RAM of the control unit 101 and the tray to be used in the job is set in the RAM (step S31). The control unit 101 checks whether the paper size specified in the job data matches to the size of the paper stored in the tray to be used or not (step S32).

Similarly, the control unit 101 checks whether the paper type specified in the job data match to the paper type of the paper stored in the tray to be used or not (step S33).

Next, the control unit 101 determines whether the set tray to be used is being reserved so that the paper thereof is to be used in other reserved job or not (step S34). When the control unit 101 determines that the set tray to be used is being reserved (step S34; YES), the job which uses this tray is displayed in the LCD 502 as the paper reservation. In particular, in the case shown in FIG. 3, the information (size and paper type information) of the paper to be used in job 3 is compared to the paper information stored in the current tray, and the reservation information R3 is displayed in orange which indicating that it is determined that the information of the paper to be used in job 3 and the information of paper stored in the current tray do not match. Here, even when the previous job which is to be executed before is in the paper reservation state (in orange), as long as the information of the paper stored in the current tray and the information of the paper to be used in the job match, it is not determined as being not matching and the display of the reservation information is to be carried out. For example, as the reservation information R5 shown in FIG. 3, the reservation information is to be displayed in yellow and not in orange.

When the control unit 101 does not determine that the set tray to be used is reserved so that the paper thereof is to be used in other reserved job (step S34; NO), the control unit 101 determines whether there is other tray to be used based on the job data of the reserved job (step S36).

When the control unit 101 determines that there is other tray to be used (step S36; YES), this tray to be used is stored in the RAM of the control unit 101 (step S37) and the process returns to step S32 and the size is checked based on this tray to be used.

When the control unit 101 does not determine that there is other tray to be used (step S36; NO), the process moves to step S5.

Figure 4:
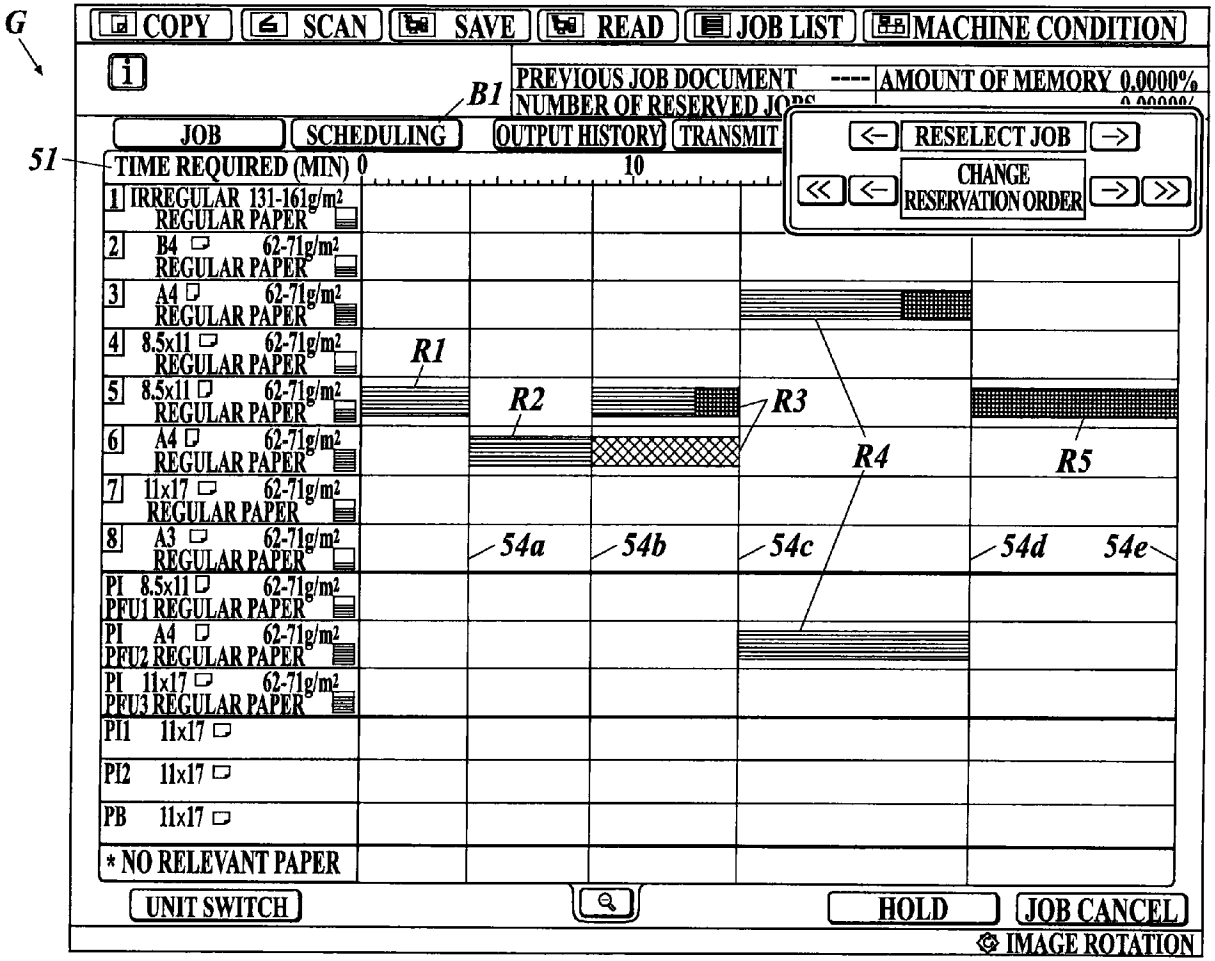
FIG. 4 is an example of the job scheduling screen which is to be displayed in the LCD shown in FIG. 2.

In FIG. 4, an example of the job scheduling screen G when a plurality of trays are used in one job is shown. In the example shown in FIG. 4, job 3 uses the trays FT5 and FT6 and job 4 uses the tray FT3 and the high-capacity post inserter PFU2. As shown in the reservation information R3 of job 3, in a case of a job that uses a plurality of trays, the reservation information of all of the trays to be used are to be display in the time required for the entire job. In such case, all of the trays to be used are compared to the paper size/paper type information of the paper stored in the current tray and the display indicating not matching is carried out for the trays which do not match to the paper size/paper type information of the paper stored in the current tray. In the example shown in FIG. 4, it is shown that the paper reservation in only carried out to the tray 6 of job 3.

With regards to the job in which the paper reservation is carried out, when the reservation information shown in orange is specified by an operation of the touch panel in the LCD 502, the tray information display screen can be displayed.

Figure 5:
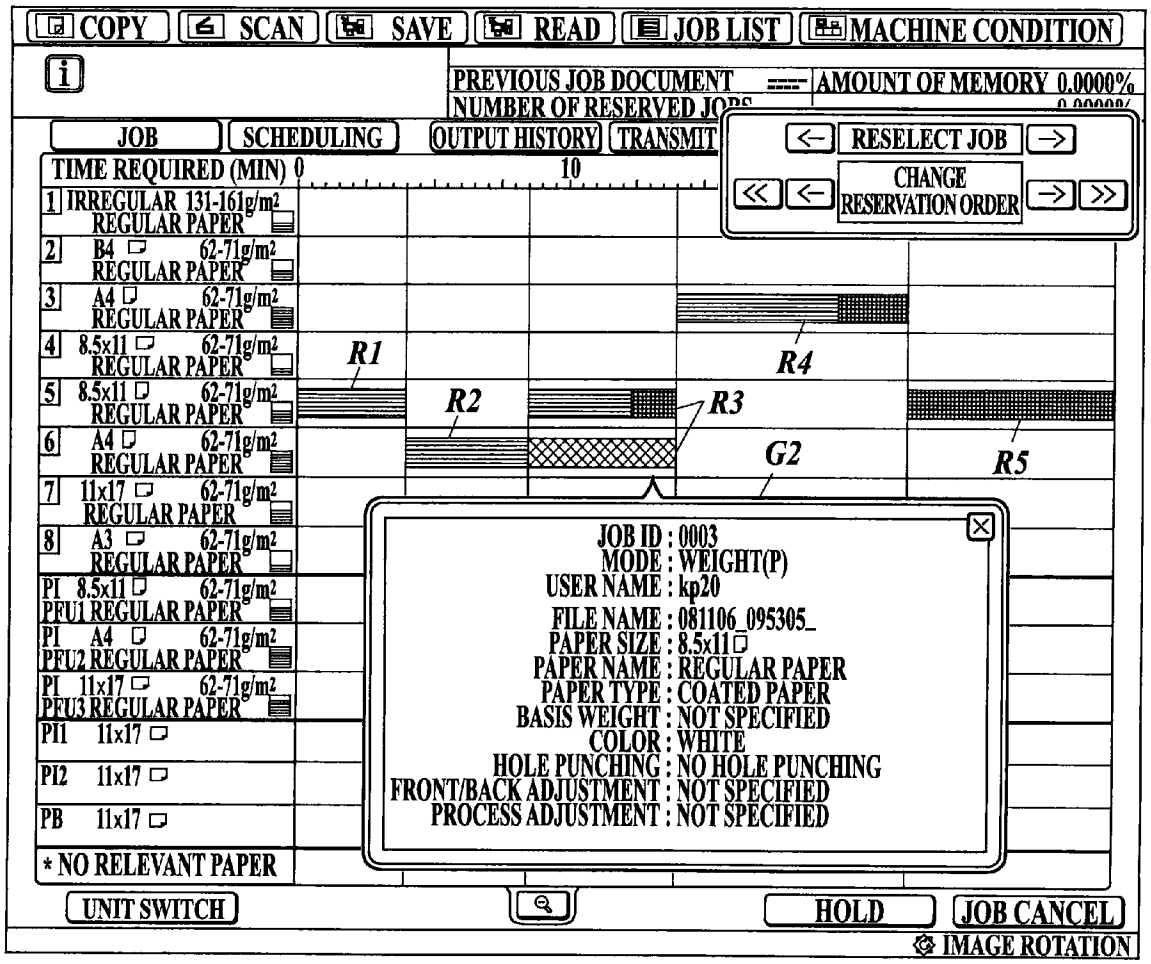
FIG. 5 is an example of the job scheduling screen which is to be displayed in the LCD shown in FIG. 2.

In FIG. 5, an example of the job scheduling screen G when the tray information display screen is being displayed is shown. In the example shown in FIG. 5, when the reservation information R3 of job 3 shown in orange is specified, the tray information display screen G2 is displayed so as to superimpose on the job scheduling screen G at the position corresponding to the tray FT6. In the tray information display screen G2, details of the corresponding tray, that is, the tray which is currently stored in the tray FT6 in the example shown in FIG. 5, are read out from the storage unit 102 and are displayed. The aspects which are different from the information specified in the job are displayed in red letters or the like. That is, in a case where the paper stored in the tray FT6 is not coated paper although coated paper is specified in job 3, the paper type is displayed in red letters or the like. Here, display which indicates not matching of the information is not limited to the above example as long as the not matching of information can be recognized by a predetermined highlighted display in the job scheduling screen G. For example, the not matching of information may be displayed by using different font for the relevant information from the fonts of other information instead of the color coded display as described above.

Figure 6:
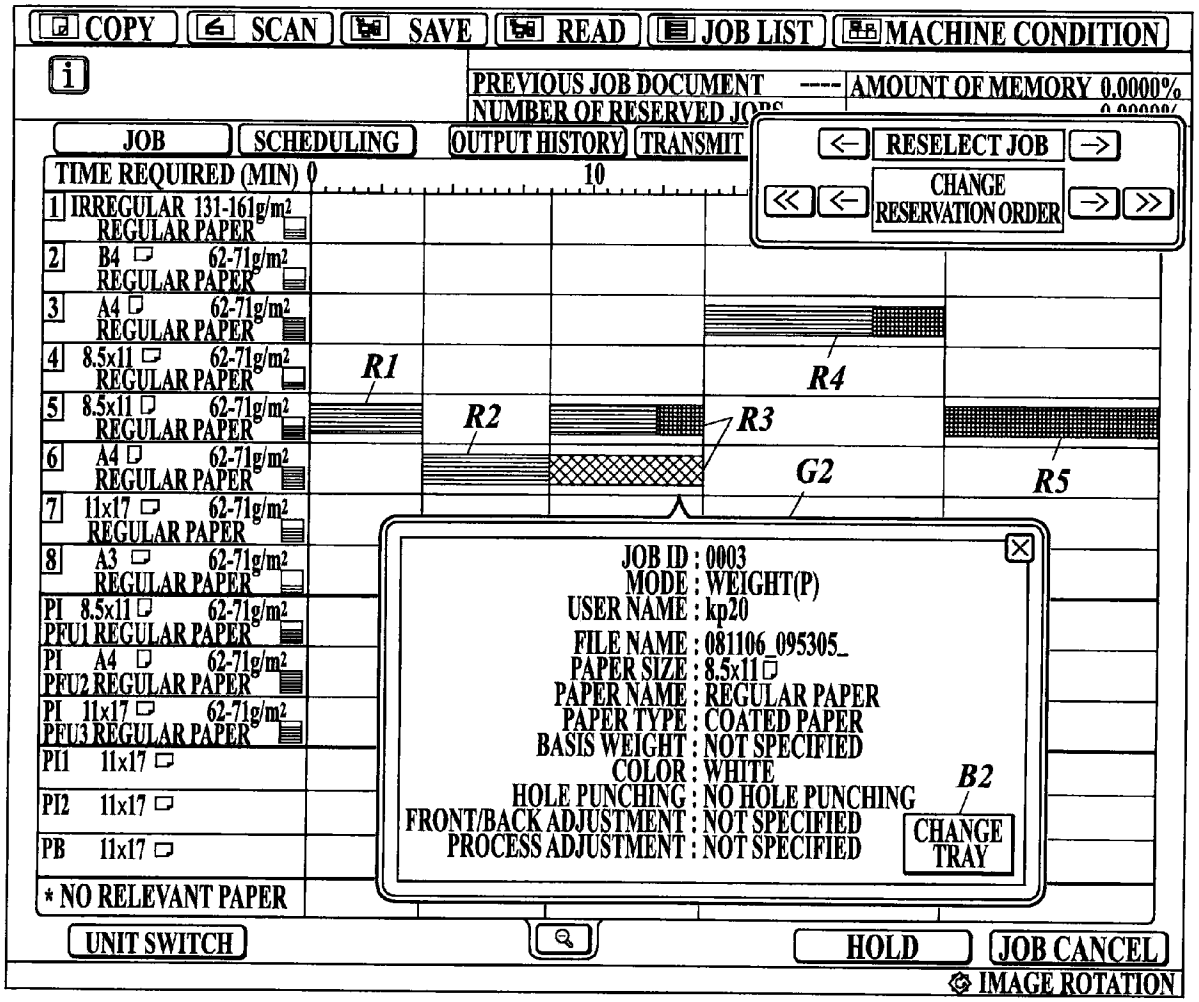
FIG. 6 is an example of the job scheduling screen which is to be displayed in the LCD shown in FIG. 2.

Moreover, in the tray information display screen G2, a change tray button B2 to change the tray to be used in the job can be provided. In FIG. 6, an example of the tray information display screen G2 which is provided with the change tray button B2 is shown. As shown in FIG. 6, when the reservation information of the job in which the tray is intended to be changed is selected, the tray information display screen G2 is displayed at the position corresponding to the job, and further, when the change tray button B2 is selected, the tray to be used in the job can be changed.

Figure 7:
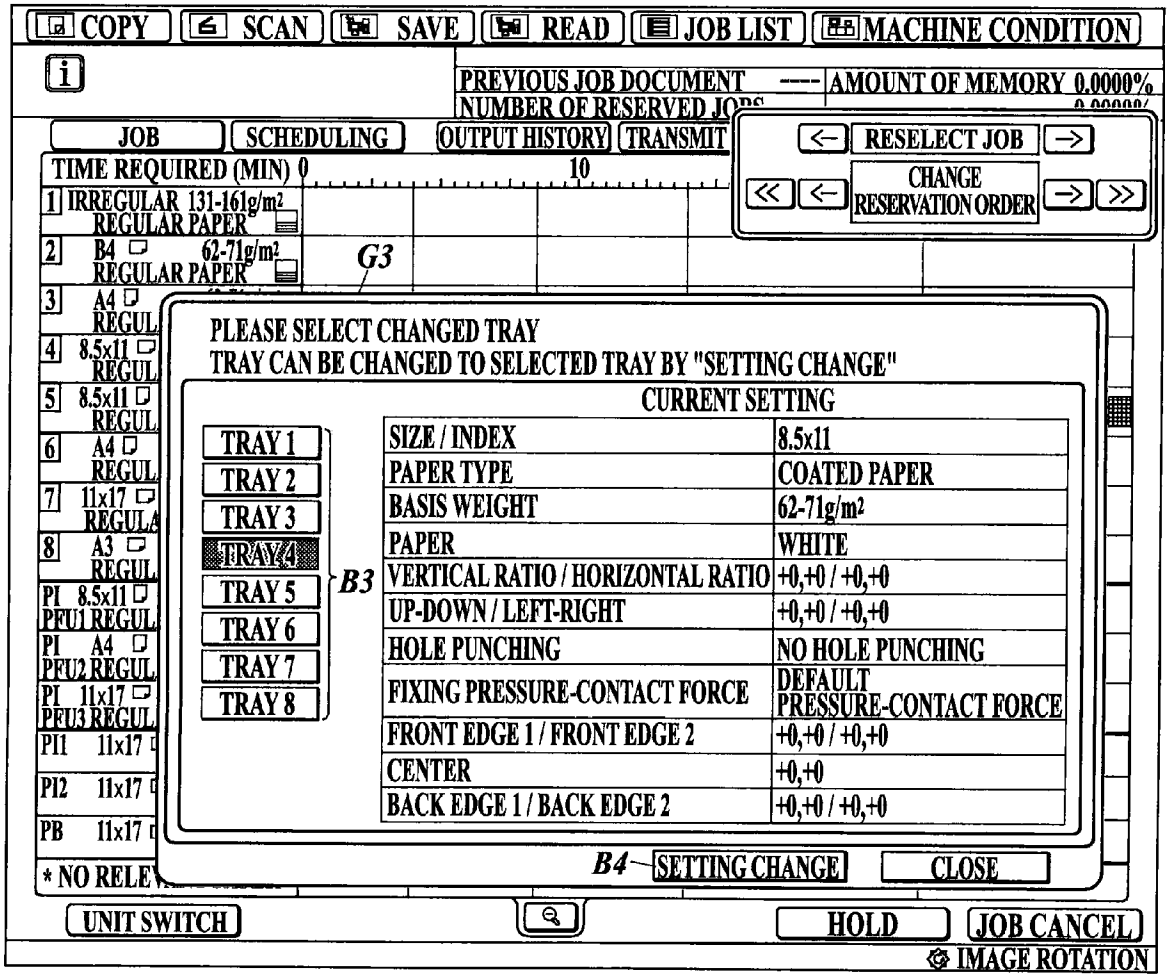
FIG. 7 is an example of the job scheduling screen which is to be displayed in the LCD shown in FIG. 2.

In FIG. 7, an example of a change order screen G3 displayed in the LCD 502 when the change tray button B2 is selected is shown. The change order screen G3 comprises tray specifying buttons B3 to specify the tray to be changed, a setting change button B4 to carry out setting change of the selected tray and the like. By selecting a tray with the tray specifying button B3 and by selecting the setting change button B4, the tray to be used in the job can be changed. When changing of the tray to be used is instructed by the operation of the setting change button B4, the tray to be used which is included in the job data of the job stored in the storage unit 102 is rewritten.

Figure 8:
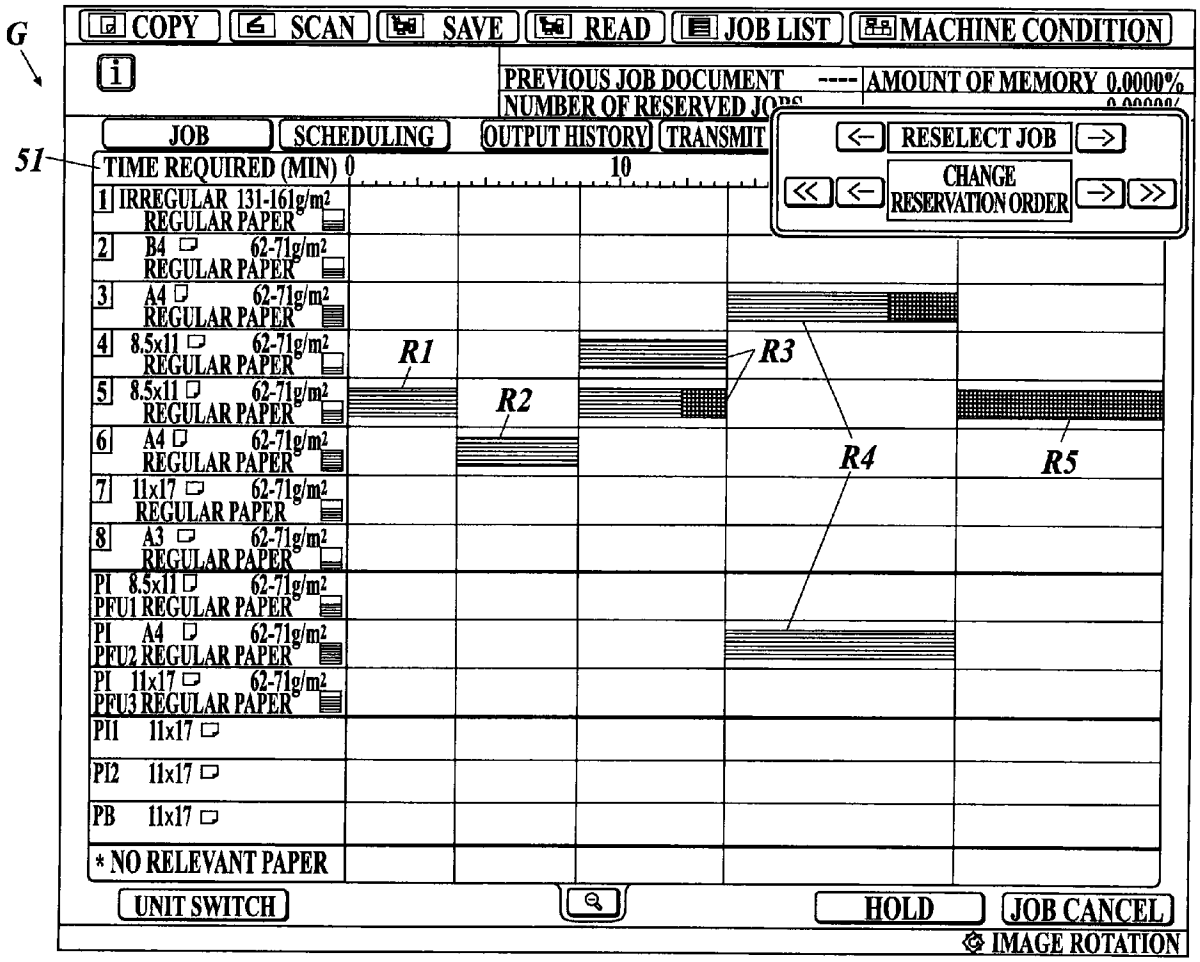
FIG. 8 is an example of the job scheduling screen which is to be displayed in the LCD shown in FIG. 2.

In FIG. 8, an example of the job scheduling screen G when the tray to be used in the job is changed is shown. In the example shown in FIG. 8, a case where the change order screen G3 is operation in the condition of the job scheduling screen G shown in FIG. 3 to change the tray to be used in job 3 to tray FT4 from tray FT6 is shown. As shown in FIG. 8, the reservation information R3 which was indicating tray FT6 is changed so as to indicate tray FT4.

Moreover, in the embodiment, by the operation in the job scheduling screen G, the reservation order of jobs which are reserved in the storage unit 102 can be switched.

Here, the print queue in which the reserved jobs which are stored in the storage unit 102 are stored will be described. In the image forming apparatus 100, the job which is being executed and the reserved jobs are controlled by the print queue.

Figure 9A:
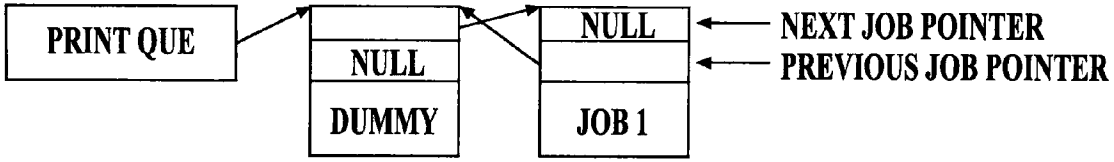
FIGS. 9A to 9D are schematic diagrams showing a print queue.

In FIG. 9A, a basic structure of the print queue is shown. As shown in FIG. 9A, the print queue is expressed in a bi-directional linear list structure. In a predetermined storage region, pointers (memory address) of the next job to be executed after the job and the previous job which is to be executed after the job are stored. Here, when the pointer of the next job to be executed after the job is NULL, this indicates that the job is the last job stored in the print queue. Further, a dummy job data indicating the beginning of the print queue is disposed at the beginning, and NULL is stored for the pointer to the job before the dummy job. The dummy job is stored at the time when the power of the image forming apparatus 100 is activated.

Next, operation of the print queue will be described. Hereinafter, description of the dummy job which is described above will be omitted.

Figure 9B:
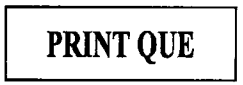
Figure 9C:
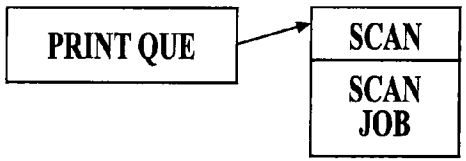
Figure 9D:
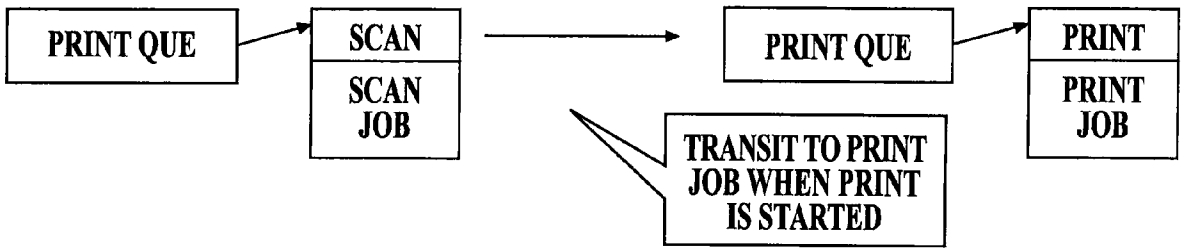

In FIG. 9B, a state where no job is stored in the print queue is shown. When scanning is started by the scanner unit 2, the command will be "scan" to read image data, which is a scan job, as shown in FIG. 9C. Next, when the scanning is finished and when printing is started, the command is switched to "print" from "scan" and transits to the print job as shown in FIG. 9D.

Next, when scanning is started during printing, the scan job is reserved after the job which is in middle of printing as shown in FIG. 10A. When the scanning is completed, the scanning of the reserved job is completed and waits for output as shown in FIG. 10B. When output of the job which is in middle of printing is completed, the completed print job is deleted and the next job after the job in which scanning is completed will be in "print" condition.

In the job scheduling screen G, switching if the order of the above described print queue can be instructed. In particular, the next job pointer and the previous job pointer of the job which is targeted for switching are to be rewritten. Further, by rewriting the pointer of the previous job and the pointer of the next job before switching and by rewriting the pointer of the previous job and the pointer of the next job of the switched destination, switching of jobs can be carried out.

Figure 11A:
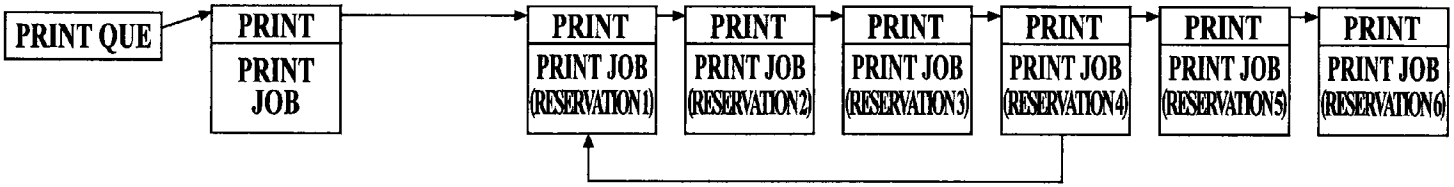
FIGS. 11A and 11B are schematic diagrams showing a print queue.
Figure 11B:
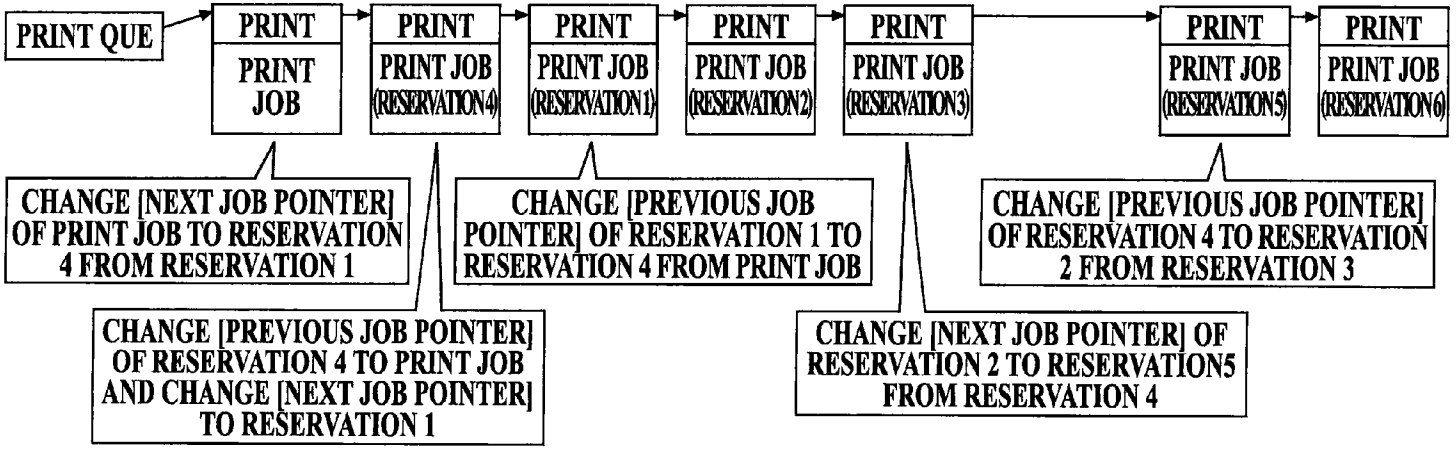

In FIG. 11A, an example of the print queue before the switching of jobs is executed is shown. In such condition, there are six jobs (reservations 1 to 6) which are in the middle of printing other than the job which is currently being executed in the print queue. When the order of reservation 1 and reservation 4 which are stored in the print queue are switched, the print queue will be in a condition as shown in FIG. 11B.

First, the next job pointer of the job which is being executed is changed to reservation 4 from reservation 1. The previous job pointer of reservation 4 is changed to the job which is being executed and the next job pointer is changed to reservation 1. The previous job pointer of reservation 1 is changed to reservation 4 from the job which is being executed. The next job pointer of reservation 2 is changed to reservation 5 from reservation 4. The previous job pointer of reservation 4 is changed to reservation 2 from reservation 3. By the print queue being changed as described above, changing in the order of the reserved jobs is carried out by the operation in the job scheduling screen G.

As described above, according to the image forming apparatus of the embodiment, paper replacement to the paper feeding unit in which paper reservation is set in the job scheduling screen can be carried out in advance. Therefore, efficient paper replacement can be assisted. Further, because the reservation information is displayed in the two-dimensional scheduling screen, a user can recognize at which timing in the job execution the paper reservation is to be set, and therefore, a user can recognize the detail of the timing of the paper replacement.

Moreover, the job in which paper reservation is set and the job which uses the paper stored in the current paper feeding unit can be distinguished and the output order of the jobs in which paper reservation is set can be switched. Further, the paper feeding unit to be used in the job can be changed in the job scheduling screen.

Here, the description in the above embodiment is an example of a preferred image forming apparatus according to the present invention, and the present invention is not limited to this. For example, a non-volatile memory such as a flash memory including a SD (Secure Digital) card, a USB (Universal Serial Bus) memory or the like and a transportable recording medium such as a CD-ROM can be applied as a computer readable medium other than the storage unit in the embodiment. Further, various types of data such as data of the programs according to the present invention and audio data can be provided via a communication circuit by superimposing on a carrier wave.

Moreover, in the embodiment, the job in which paper reservation is set is displayed in reservation information of orange to be notified. However, the display is not limited to this as long as a predetermined display which is specified in advance is carried out. For example, a predetermined icon (paper replacement mark) may be displayed at the corresponding position of the job in the job scheduling screen or the reservation information may be displayed with hatching or the like.

Further, regarding detail operation of the image forming apparatus, arbitrary changes can be carried out within the scope of the present invention.

The entire disclosure of Japanese Patent Application No. 2009-123844 filed on May 22, 2009 is incorporated herein by reference in its entirety.

What is claimed is:

1. An image forming apparatus, comprising:

a storage unit which stores job data of a reserved job;

an image forming unit which executes an image forming based on the job data of the reserved job;

a paper feeding unit which stores a paper to be supplied to the image forming unit;

a display unit;

a control unit which determines whether a type of a paper to be used in the reserved job is different from a type of a paper to be stored in the paper feeding unit or not, wherein responsive to a determination that the type of the paper to be used in the reserved job is different from the type of the paper to be stored in the paper feeding unit, the control unit controls the display unit to display a job scheduling screen for displaying reservation information indicating a time required for an execution of the reserved job by including a predetermined notification.

2. The image forming apparatus of claim 1, wherein the job scheduling screen which is displayed by the control unit displays the reservation information of the reserved job in a table in which a first axis indicates paper feeding tray information and a second axis orthogonal to the first axis indicates the time required for the execution of the reserved job, andthe control unit calculates a time required for an execution of a job based on the job data and displays reservation information having a length in the second axis corresponding to the calculated time required, and the control unit determines whether the type of the paper to be used in the reserved job is different from the type of the paper to be stored in the paper feeding unit or not and the control unit controls the display unit to display the reservation information of the reserved job in which the type of the paper to be used is different from the type of the paper to be stored in the paper feeding unit with a display different from the display for reservation information of another reserved job.

3. The image forming apparatus of claim 2, wherein the control unit displays the reservation information of the reserved job in which the type of the paper used is different from the type of the paper used to be stored in the paper feeding unit with a display different from the display for the reservation information of the another job by using any one of a color display of the reservation information, a display of a paper replacement mark or a hatching display of the reservation information.

4. The image forming apparatus of claim 1, further comprising an operation unit, wherein when reservation information which is displayed in the display unit is selected by the operation unit, the control unit displays information of a paper specified in job data of a job corresponding to the reservation information which is different from information relating to a paper to be stored in the paper feeding unit so as to be highlighted in the job scheduling screen.

5. The image forming apparatus of claim 1, further comprising an operation unit, wherein responsive to the selection of one or more reservations information which are displayed in the display unit by the operation unit, the control unit switches an execution order of jobs corresponding to the one or more reservations information.

6. The image forming apparatus of claim 1, further comprising an operation unit, wherein when reservation information which is displayed in the display unit is selected by the operation unit, the control unit changes the paper feeding unit to be used in a job corresponding to the selected reservation information.

7. An image forming apparatus, comprising:

a storage unit which stores job data of a reserved job;

an image forming unit which executes an image formation based on the job data of the reserved job;

a paper feeding unit which stores a paper to be supplied to the image forming unit;

a display unit which displays a job scheduling screen including a reservation information of a reserved job in a table wherein a first axis indicates information relating to paper per paper feeding unit and a second axis orthogonal to the first axis that indicates a time required for an execution of the reserved job;

a control unit which determines whether a type of a paper to be used in the reserved job is different from a type of a paper to be stored in the paper feeding unit, wherein the control unit calculates the time required for the execution of a job based on the job data and displays reservation information having a length in the second axis corresponding to the calculated time required, determines whether the type of the paper to be used in the reserved job is different form the type of the paper to be stored in the paper feeding unit, and responsive to a determination that the type of the paper to be used in the reserved job is different from the type of the paper to be stored in the paper feeding unit, the control unit controls the display unit to display the job scheduling screen of the reserved job by includes a predetermined notification.

8. The image forming apparatus of claim 7, wherein the control unit controls the display unit to display the reservation information of the reserved job in which the type of the paper to be used is different from the type of the paper to be stored in the paper feeding unit with a display different from the display for reservation information of another reserved job.

9. The image forming apparatus of claim 8, wherein the control unit controls the display unit to display the reservation information of the reserved job in which the type of the paper to be used is different form the type of the paper to be used is different from the type of the paper to be stored in the paper feeding unit with a display different from the display for reservation information of the another reserve job by using any one of a color display of the reservation information, a display of a paper replacement mark or a hatching display of the reservation.

10. The image forming apparatus of claim 7, further comprising an operation unit, wherein when reservation information displayed in the display unit is selected by the operation unit, the control unit displays information of a paper specified in job data of a job corresponding to the selected reservation information which is different from information relating to the paper to be stored in the paper feeding unit so as to be highlighted in the job scheduling screen.

11. The image forming apparatus of claim 7, further comprising an operation unit, wherein responsive to the selection of one or more reservations information displayed in the display unit by the operation unit, the control unit switches an execution order of jobs corresponding to the one or more reservations information.

12. The image forming apparatus of claim 7, further comprising an operation unit, wherein when reservation information displayed in the display unit is selected by the operation unit, the control unit changes the paper feeding unit to be used in a job corresponding to the selected reservation information.

* * * * *